US009595406B2

(12) United States Patent
Morita

(10) Patent No.: US 9,595,406 B2
(45) Date of Patent: Mar. 14, 2017

(54) SWITCH STRUCTURE AND DISPLAY DEVICE

(71) Applicant: Funai Electric Co., Ltd., Daito-shi, Osaka (JP)

(72) Inventor: Shinji Morita, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 62 days.

(21) Appl. No.: 14/220,497

(22) Filed: Mar. 20, 2014

(65) Prior Publication Data

US 2014/0293520 A1 Oct. 2, 2014

(30) Foreign Application Priority Data

Apr. 2, 2013 (JP) ..... 2013-077161

(51) Int. Cl.
*H05H 7/00* (2006.01)
*H01H 13/02* (2006.01)
*H01H 21/06* (2006.01)

(52) U.S. Cl.
CPC ..... *H01H 13/02* (2013.01); *H01H 21/06* (2013.01)

(58) Field of Classification Search
CPC ..... H01H 13/02; H01H 21/06
USPC ..... 361/679.01
See application file for complete search history.

(56) References Cited

U.S. PATENT DOCUMENTS 7,852,321 B2 * 12/2010 Uotani ..... G06F 3/0338 200/4
2008/0116045 A1 * 5/2008 Matsutani ..... H01H 13/50 200/293
2012/0061216 A1 * 3/2012 Kawakami ..... B25F 5/02 200/302.2
2013/0075243 A1 * 3/2013 Tsuchiya ..... H01H 13/52 200/600

FOREIGN PATENT DOCUMENTS

JP 67-194230 U1 6/1981
JP 05-027929 U 4/1993
JP 08-077868 A 3/1996
JP 2002-025391 A 1/2002
JP 2007-11012 A 1/2007
JP 2012-243633 A 12/2012

* cited by examiner

*Primary Examiner* — Tuan T Dinh
*Assistant Examiner* — Rockshana Chowdhury
(74) *Attorney, Agent, or Firm* — Keating & Bennett, LLP

(57) ABSTRACT

A switch structure includes an operation key attachment, a substrate facing the operation key attachment and including a switch at least a portion of which is exposed from an opening, and an operation key including a protrusion that protrudes parallel or substantially parallel to the substrate from an opening end surface, an operation receiver at a tip end of the protrusion and that accepts a user pressing operation in the direction toward the substrate, and a pressing member that extends from the operation receiver in a direction that defines a first angle spanning between the pressing member and the protrusion, and is used to press the switch.

20 Claims, 19 Drawing Sheets

SWITCH STRUCTURE AND DISPLAY DEVICE

BACKGROUND OF THE INVENTION

1. Field of the Invention

The present invention relates to a switch structure and a display device including such a switch structure.

2. Description of the Related Art

There has been demand in recent years for liquid crystal display devices that have narrower bezels and that are thinner in the depth direction. To this end, the front cabinet that encloses the liquid crystal panel is formed so as to make the dimensions smaller in the up/down, left/right, and depth directions when the liquid crystal display is viewed from the front. There are techniques for providing an operation key for performing various types of setting of the liquid crystal panel on a front cabinet with such small dimensions, including the technique described in Japanese Patent Application Laid-Open Publication No. 2007-11012.

FIGS. 13A and 13B are diagrams showing the structure of conventional operation keys. Note that in FIGS. 13A and 13B, Y1 indicates the direction toward the front, while Y2 indicates the direction toward the rear.

In this example, a cover 300 is attached to a front cabinet 11 as shown in FIG. 13A so as to be able to close and open. A plurality of operation keys 400 are provided on the front surface of the cover 300. FIG. 13B shows a state in which the cover 300 is open, with a substrate 200 being secured by a rib 500 such that switches 203 face in the forward direction. With this constitution, the switches 203 are pressed if the operation keys 400 are pressed with the cover 300 in the closed state.

However, with the method for attaching the operation keys 400 to the cover 300 in this manner, the cover 300 needs to be separately provided, which is a factor leading to increased costs.

Meanwhile, there is a method for forming operation keys without adding any separate components. FIG. 14 is a side view showing an operation key that is formed without adding any separate components. Note that in FIG. 14, X1 indicates the direction to the left, while X2 indicates the direction to the right. Furthermore, Y1 indicates the direction toward the front, while Y2 indicates the direction toward the rear. Moreover, Z2 indicates the downward direction.

In FIG. 14, a plurality of ribs (not shown) are provided on the lower portion of the front cabinet 11 in order to hold the substrate 200. The substrate 200 is held by the various ribs such that it is sandwiched in the thinnest direction of the substrate 200.

Openings 1110 are formed in the front cabinet 11. The switches 203 disposed on the substrate 200 are exposed from the openings 1110. As will be described later, each switch 203 includes a switch main body part 201 that is pressed in by an operation key 400 and a metal plate 202 that surrounds the switch main body part 201 and that has a square exterior shape.

A protruding part 401 protrudes from an end surface 1110A of an opening 1110, and the operation key 400 that receives the pressing operation by the user is formed at the tip end of the protruding part 401.

The protruding parts 401 have elasticity in the forward direction with respect to the front cabinet 11, and when the operation keys 400 are operated, the protruding parts 401 are pushed in the rearward direction in opposition to the elastic force, and the contact surfaces 400S press on the surfaces of the switch main body parts 201. Thus, the operation keys 400 are formed by effectively utilizing the narrow region of the front cabinet 11 without adding any separate components.

However, the following problems are encountered in the operation keys. FIGS. 15A-15C are diagrams illustrating the problems of the operation key of FIG. 14. Note that FIG. 15A is a plan view of the operation key 400, FIG. 15B is a perspective view of the operation key 400, and FIG. 15C is a perspective view representing the positional relationship between the protruding part 401 and the metal plate 202.

The operation key 400 is provided at the tip end of the protruding part 401 that protrudes from the opening end surface 1110A which is an end surface of an opening 1110 as shown in FIG. 15A and FIG. 15B. In addition, the switch main body part 201 and the square-shaped metal plate 202 that surrounds the switch main body parts 201 are exposed from the opening 1110.

With this constitution, when the operation key 400 is pressed, it is often the case that the upper surface of the protruding part 401 comes in contact with the metal plate 202 of the switch 203 in a state in which the operation key 400 is not solidly depressing the switch main body part 201 as shown in FIG. 15B and FIG. 15C.

In particular, in cases where the distance h from the opening end surface 1110A to the operation key 400 is not adequately secured in the protruding part 401 as shown in FIG. 16, it is difficult to press the operation key 400 against the elastic force of the protruding part 401.

Furthermore, even if one attempts to form an operation key 400 as in FIG. 17A on the front cabinet 11, on most types of front cabinets 11, there are a plurality of ribs 500 for securing the substrate 200 as shown in FIG. 17B. Typically, in order to form operation keys 400 such as in FIG. 17A with resin using molds, the molds require slide mechanisms, but a slide mechanism cannot be used when the ribs 500 are provided as in FIG. 17B.

SUMMARY OF THE INVENTION

Accordingly, preferred embodiments of the present invention provide a switch structure that improves the operability of operation keys without adding any separate components, and a display device including such a switch structure.

A switch structure according to a preferred embodiment of the present invention includes an operation key attachment provided with an opening, a substrate facing the operation key attachment and including a switch at least a portion of which is exposed from the opening in the operation key attachment, and an operation key including a protrusion that protrudes parallel or substantially parallel to the substrate from an opening end surface which is an end surface of the opening, an operation receiver that is provided at a tip end of this protrusion and that accepts a user pressing operation in a direction toward the substrate, and a pressing member that extends from the operation receiver in a direction defined by a predetermined first angle with respect to the protrusion and that is used to press the switch.

With this constitution, the protrusion extends in a direction that defines the predetermined first angle between the protrusion and the pressing member to press the switch, so it is possible to significantly reduce or minimize the portion of the surface area of the protrusion that faces the switch.

For this reason, when the operation receiver receives the pressing operation by the user, the protrusion is less likely to strike the switch. As a result, it is possible to improve the operability of the operation key without adding any separate components.

The first angle may be 90° or about 90°, for example.

With this constitution, the angle between the protrusion and the pressing member is 90° or about 90°, so the protrusion is easily configured so as not to face the switch.

Moreover, the switch may include a switch main body that is pressed by the pressing member and a housing that encloses the outer periphery of the switch main body, the pressing member may include a surface on the side of the switch main body, and this surface may be inclined with respect to the surface of the switch main body at a predetermined second angle.

With this constitution, of the pressing member that comes in contact with the surface of the switch main body, the surface on the side of the switch main body is inclined at the second angle with respect to the surface of the switch main body. Consequently, the inclined tip end of the pressing member presses the switch when the operation receiver receives the pressing operation by the user. As a result, the user receives a light "clicking" sensation.

Alternatively, the protrusion may be provided with a rib that extends from the operation receiver in the direction toward the opening end surface.

With this constitution, a rib extending from the operation receiver in the direction toward the opening end surface is provided on the protrusion, so the protrusion has strong rigidity in the portions where the rib is provided, but the rigidity of the portions in the vicinity of the opening end surface is weak.

Therefore, when the operation receiver receives the pressing operation by the user, the pressing member moves smoothly with the vicinity of the opening end surface as the fulcrum, thus pressing the surface of the switch main body. Because of this, even if the pressing operation is performed with a weak force, the user receives a light "clicking" sensation.

In addition, a recess may be provided at the portion connecting the protrusion and the opening end surface.

With this constitution, because a recess is provided at the portion connecting the protrusion and the opening end surface, the protrusion has weak rigidity in the area of the recess, but the rigidity is strong in the other areas.

For this reason, when the operation receiver receives the pressing operation by the user, the pressing member moves smoothly with the recess as the fulcrum, thus pressing the surface of the switch main body. As a result, the user receives a light "clicking" sensation even when performing a pressing operation with a weak force.

Furthermore, the operation key attachment and the operation key may be constituted of resin, the housing may be constituted by a metal plate having a square or substantially square external shape, and the four corners of the metal plate may be covered by the operation key attachment and the operation key, for example.

With this constitution, because the four corners of the square-shaped or substantially square-shaped metal plate enclosing the switch main body are covered with resin, it is possible to reduce the generation of static electricity in the switch.

Moreover, when θ represents the second angle, a represents the distance, in a state in which the switch main body is not being operated, from the surface of the switch main body to the location on the pressing member that strikes the surface of the switch main body (hereinafter referred to as the "action point"), b represents the distance by which the action point is pressed into the switch main body from the time when the action point comes into contact with the surface of the switch main body until the switch main body is pressed in, and c represents the distance between the protrusion and the metal plate in a state in which the switch main body is pressed in by the action point, the angle θ preferably satisfies Expression 1 below:

$$\theta > \tan^{-1}\{(a+b)/c\} \quad \text{(Expression 1)}$$

With this constitution, as long as the second angle satisfies Expression 1, the switch can be pressed without any interference between the switch and the protrusion.

In addition, the operation receiver may be a convex key, for example.

With this constitution, because the operation receiver is a convex key, the operation receiver accepts the pressing operation by the user more easily.

Furthermore, the display device according to another preferred embodiment of the present invention includes the switch structure according to any one of the preferred embodiments described above, a display that displays images, and a front cabinet that encloses the outer periphery of the display, wherein the operation key attachment is provided on the lower portion of the front cabinet.

With this constitution, because the switch structure is provided, a display device that achieves advantageous effects is provided.

With various preferred embodiments of the present invention, it is possible to improve the operability of the operation key without adding any separate components.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 8A and 8B are diagrams illustrating an example of a method for determining a second angle wherein FIG. 8A represents a surface view of an operation key and a switch, and FIG. 8B is a sectional view along line A-A in FIG. 8A.

DETAILED DESCRIPTION OF THE PREFERRED EMBODIMENTS

Preferred embodiments of the present invention will be described in detail below with reference to the drawings. Note that in these preferred embodiments, a liquid crystal display device will be described as an example of the display device according to the preferred embodiments of the present invention; however, the present invention is not limited to this example, and any display device may be used as long as it is a display device which is desired to be thinner and in which it is necessary to provide an operation key on the front cabinet that encloses the liquid crystal panel.

Furthermore, the preferred embodiments to be described below each illustrate a comprehensive or specific example. The constituent elements, the disposed positions and modes of connection of the constituent elements, and so forth indicated in the following preferred embodiments are just examples and do not limit the present invention. Moreover, among the constituent elements in the preferred embodiments below, constituent elements not recited in independent claims, which indicate the highest-level concepts, are described as arbitrary constituent elements.

Preferred Embodiment 1

Figure 1:
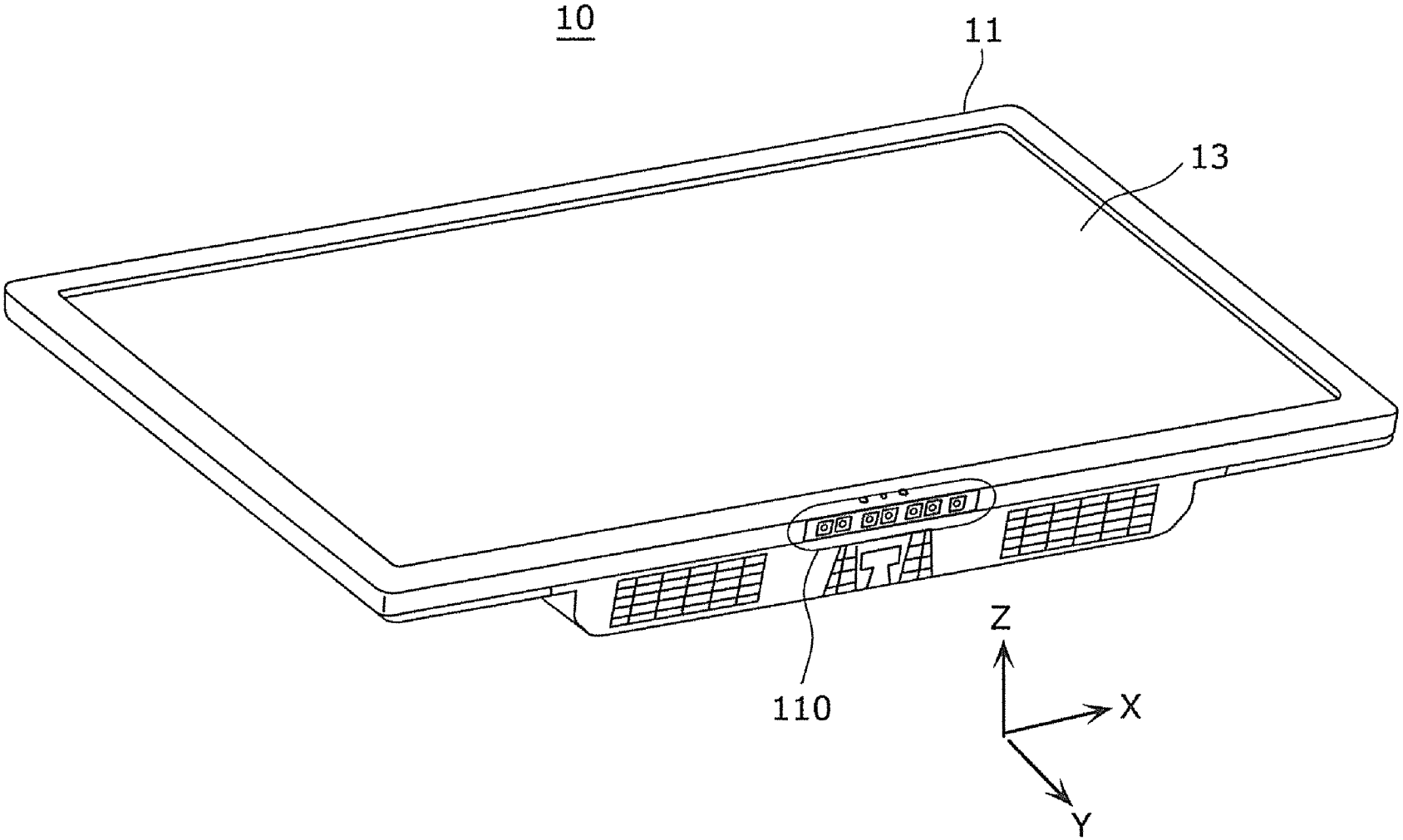
FIG. 1 is a perspective view showing one example of an external appearance of a liquid crystal display device according to Preferred Embodiment 1 of the present invention.
Figure 2:
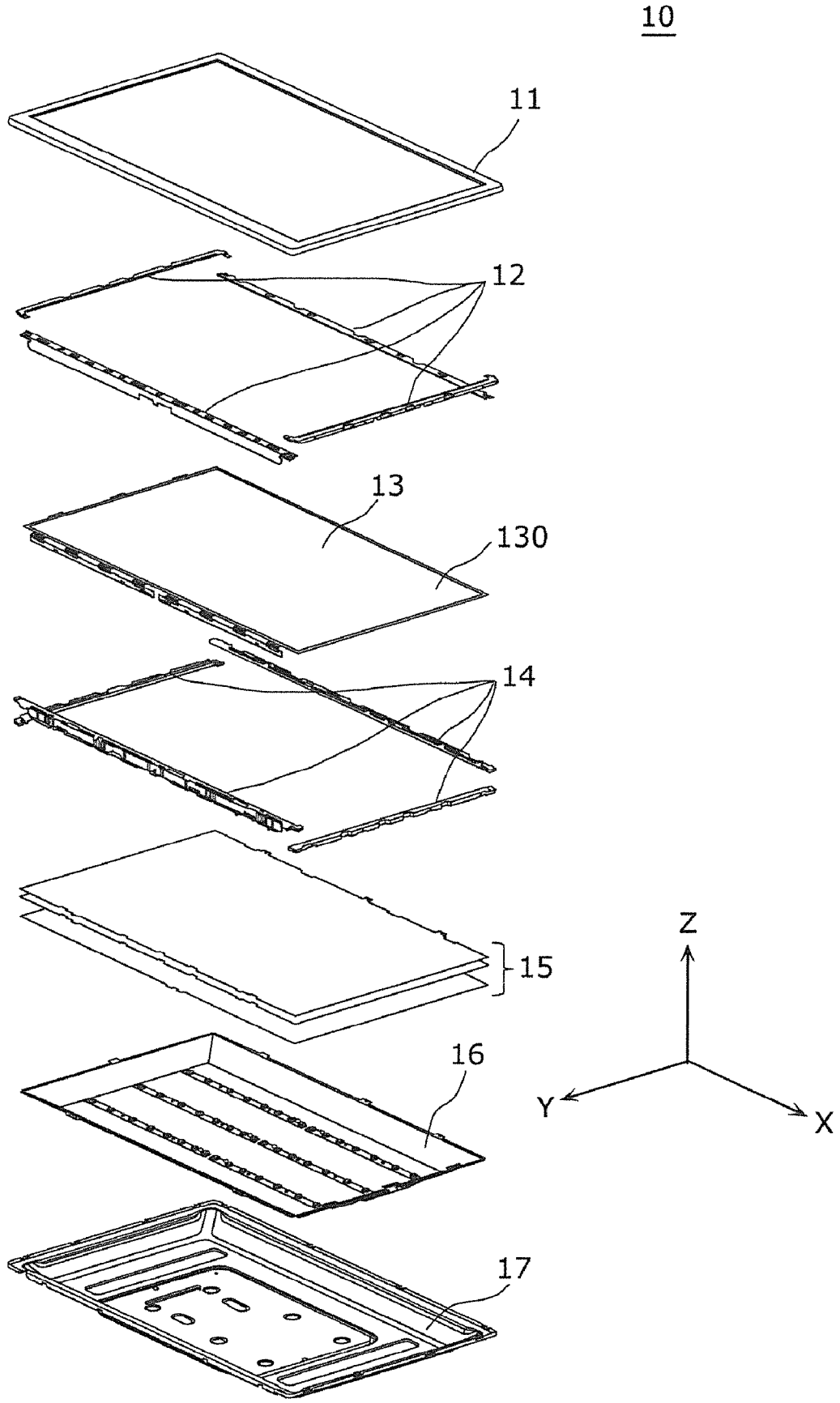
FIG. 2 is an exploded perspective view showing the liquid crystal display device of FIG. 1 in an exploded state.

FIG. 1 is a perspective view showing one example of an external appearance of the liquid crystal display device according to Preferred Embodiment 1 of the present invention. FIG. 2 is an exploded perspective view showing the liquid crystal display device of FIG. 1 in the exploded state. Note that in FIGS. 1 and 2, the horizontal direction of the liquid crystal display device is represented as the X-axis direction, the vertical direction is represented as the Y-axis direction, and the thickness direction is represented as the Z-axis direction.

As shown in FIG. 1, the liquid crystal display device includes a front cabinet 11 that encloses a liquid crystal display panel 13. An operation key attachment 110 is provided on the lower portion of the front cabinet 11.

As shown in FIG. 2, the liquid crystal display device 10 includes the front cabinet 11, a bezel 12, the liquid crystal display panel (display unit) 13, a cell guide 14, optical sheets 15, a reflector sheet 16, and a rear frame 17. Note that the optical sheets 15 are made up of a plurality of members, including a diffuser and the like.

Figure 3:
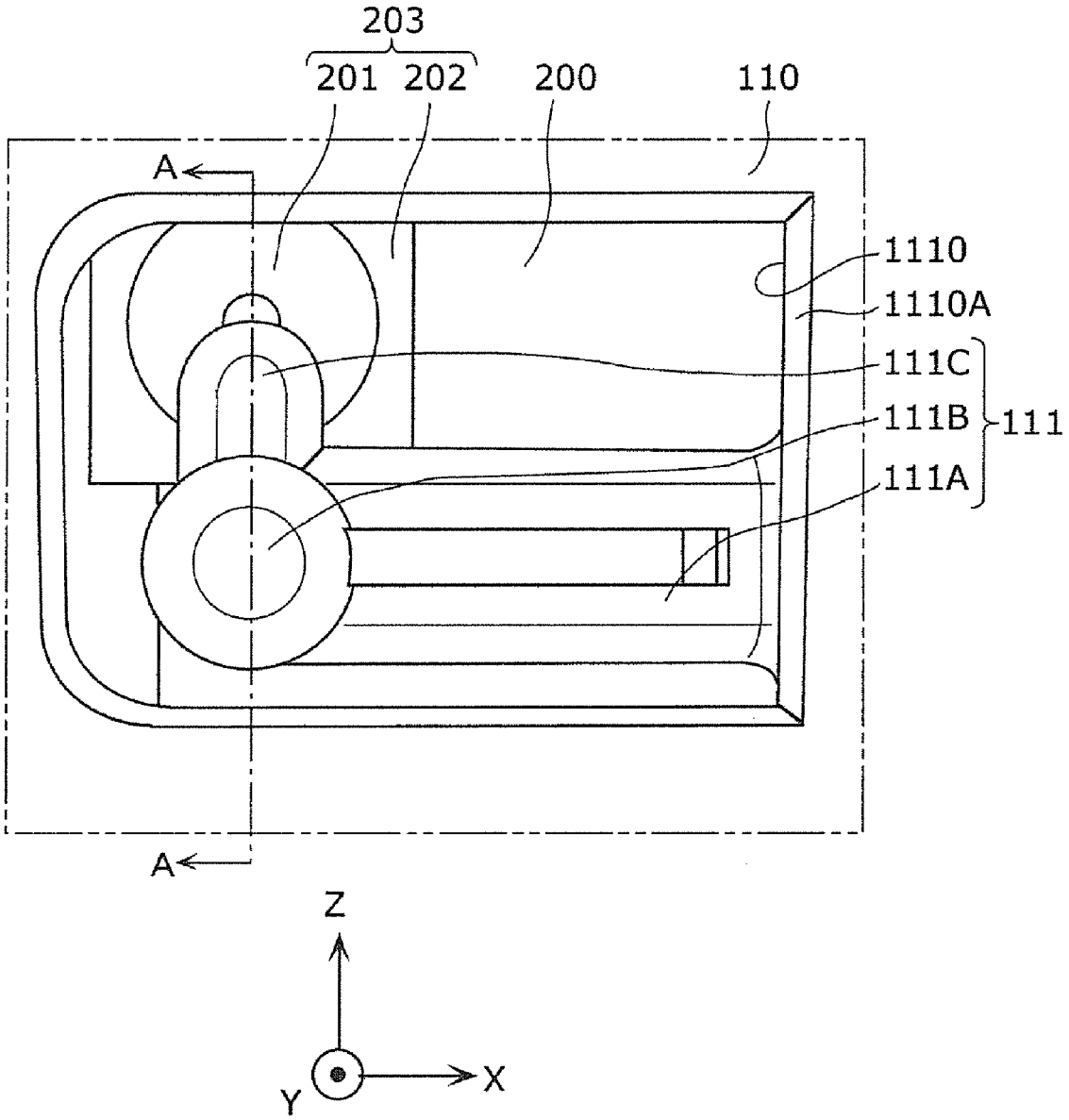
FIG. 3 is a plan view showing one example of a switch structure according to Preferred Embodiment 1 of the present invention.
Figure 4:
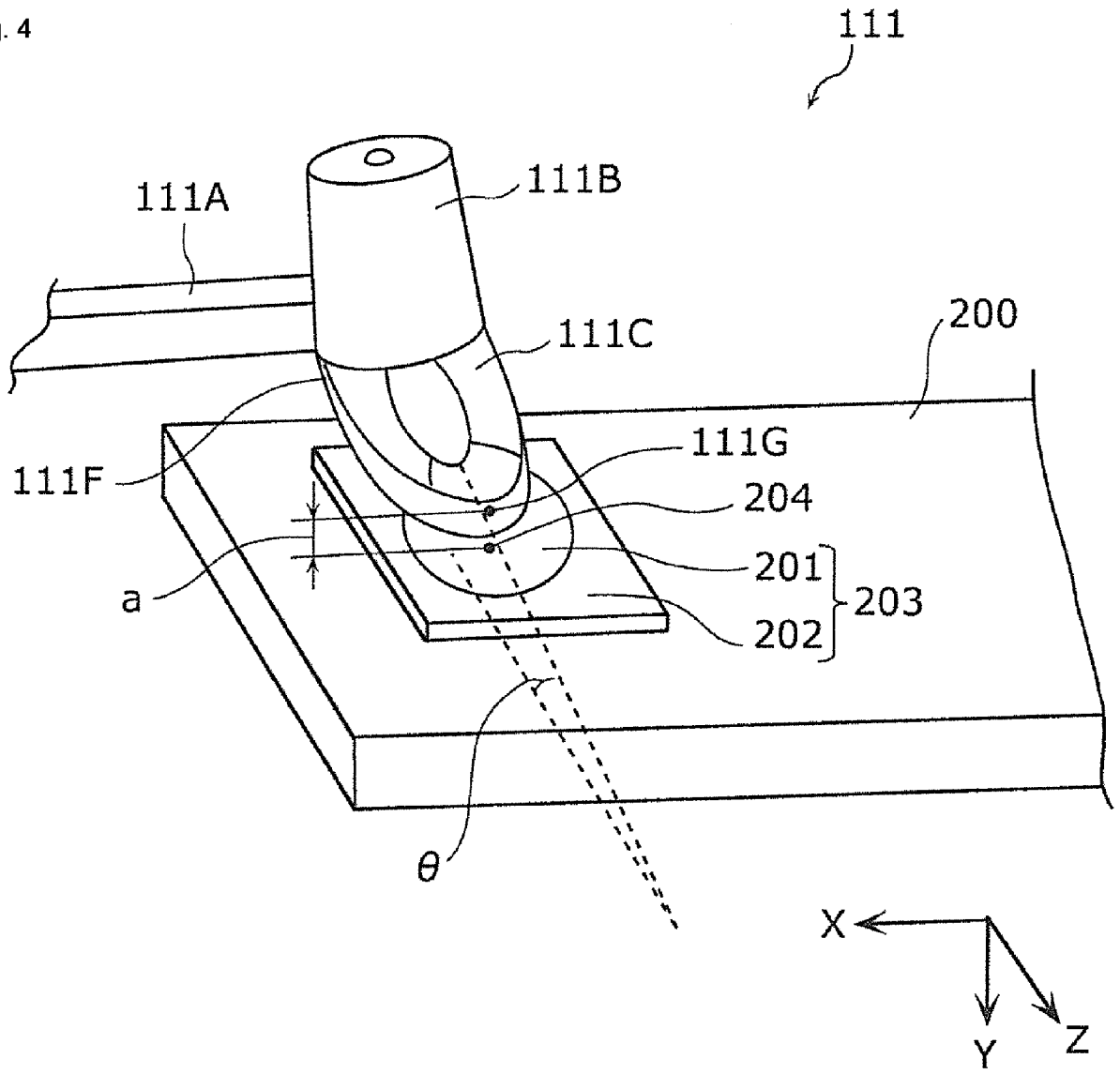
FIG. 4 is a perspective view showing one example of a positional relationship between an operation key and a switch.
Figure 5:
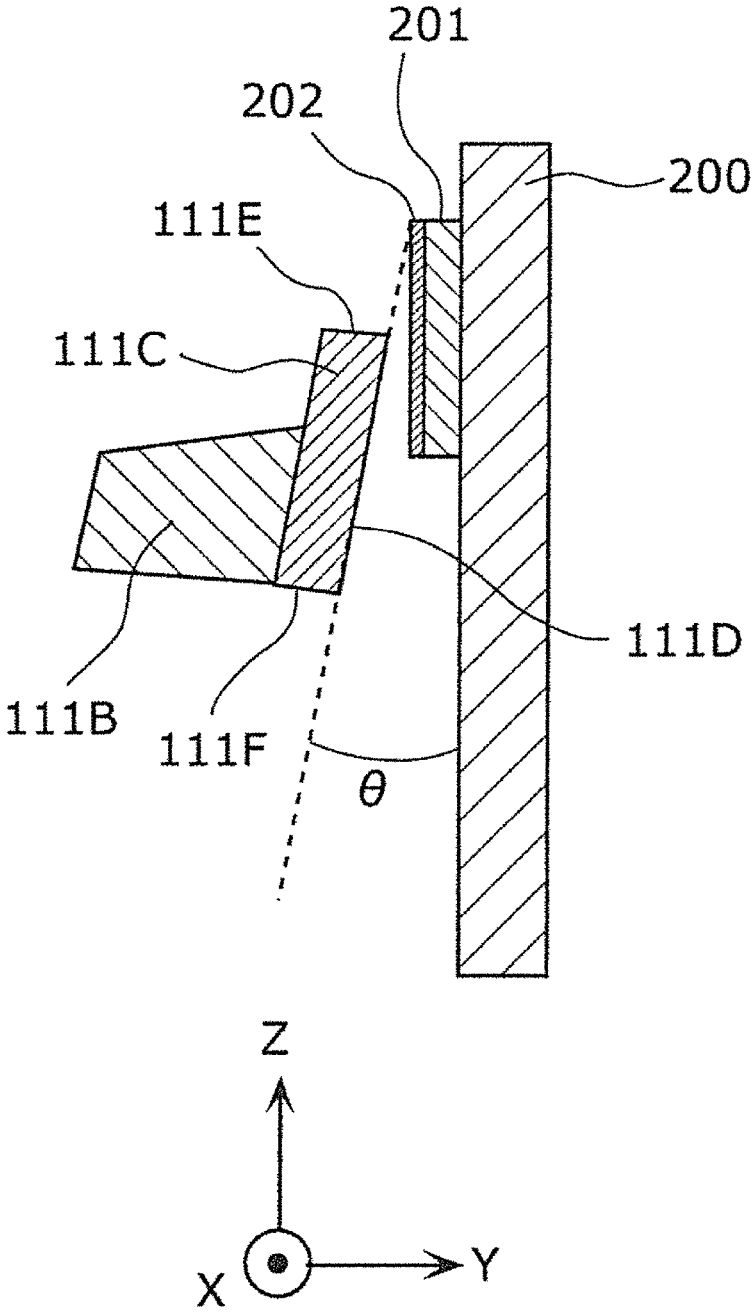
FIG. 5 is a sectional view along line A-A in FIG. 3.
Figure 6:
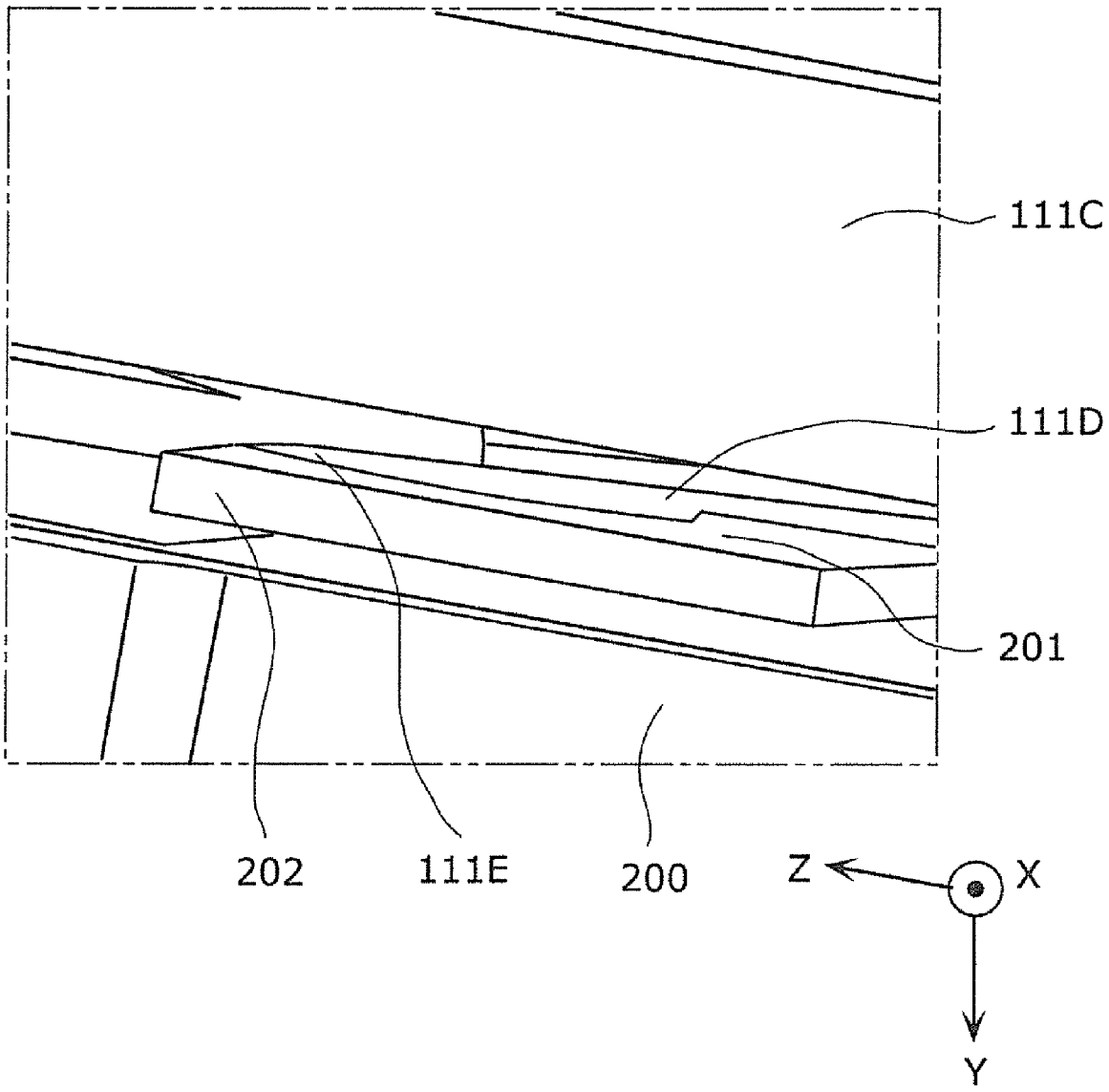
FIG. 6 is a perspective view showing a state in which a pressing member is in contact with a switch main body.

FIG. 3 is a plan view showing one example of the switch structure according to Preferred Embodiment 1 of the present invention. FIG. 4 is a perspective view showing one example of the positional relationship between an operation key and a switch. FIG. 5 is a sectional view along line A-A in FIG. 3. FIG. 6 is a perspective view showing a state in which a pressing member is in contact with a switch main body.

Note that in FIGS. 3 to 6, the horizontal direction of the liquid crystal display device 10 is represented as the X-axis direction, the vertical direction is represented as the Y-axis direction, and the thickness direction is represented as the Z-axis direction.

The operation key attachment 110 is provided on the lower portion of the front cabinet 11 as described above. As shown in FIG. 3, openings 1110 are provided in the operation key attachment 110. A substrate 200 is secured by the ribs so as to face the back surface of the operation key attachment 110 (i.e., the lower portion of the front cabinet 11). Switches 203 are provided on the substrate 200 so as to be exposed from the openings 1110.

Each switch 203 includes a switch main body 201 that accepts pressing operations. The switch main body 201 is accommodated within a housing constituted by a metal plate 202 preferably having a square or substantially square external shape. The metal plate 202 encloses the outer periphery of the switch main body 201. The surface of the switch main body 201 becomes indented slightly when the center 204 (see FIG. 4) of this surface is pressed. A switch main body (not shown) is built into the switch main body 201. The built-in switch main body becomes indented slightly when the center 204 of the switch main body 201 is pressed, so it turns on or off in response.

Meanwhile, an operation key 111 includes a protrusion 111A, a key 111B, and a pressing member 111C.

As shown in FIG. 3, the protrusion 111A protrudes from the end surface 1110A of the opening 1110 (hereinafter referred to as the "opening end surface") in a direction perpendicular or substantially perpendicular to the opening end surface 1110A.

As shown in FIG. 4, the convex key (operation receiver) 111B which receives the pressing operation by the user is provided at the tip end of the protrusion 111A. Because the operation receiver is defined by the convex key 111B, it becomes easier for the operation receiver to receive the pressing operation by the user.

As shown in FIG. 3 and FIG. 4, the pressing member 111C preferably extends from the key 111B in a direction that defines a predetermined first angle (for example, 90° or about) 90° with respect to the protrusion 111A. The tip end 111E of the pressing member 111C is positioned directly above the center 204 of the switch main body 201.

In the operation key 111, as shown in FIG. 4 and FIG. 5, the back surface 111D of the pressing member 111C (the surface on the side of the switch main body 201) is provided so as to define a predetermined specified angle θ (second angle) with respect to the surface of the switch main body 201. In order for the angle θ to be distended with respect to the switch main body 201, the pressing member 111C is configured such that the back surface 111D of the pressing member 111C becomes farther away when heading toward the direction opposite to the Z-axis direction of the liquid crystal display device 10 while maintaining the angle θ with respect to the switch main body 201.

The actions of the operation key 111 when the key 111B is operated by the press of the user will be described below using FIGS. 4 to 6.

When the user presses the key 111B, the protrusion 111A flexes upward in opposition to the elastic force thereof. Together with this, the pressing member 111C is lowered in the downward direction. The back surface 111D of the pressing member 111C is provided with the angle θ spanning between the back surface 111D and the surface of the switch main body 201 so as to be farther away from the surface of the switch main body 201 when heading toward the direction opposite to the Z-axis direction of the liquid crystal display device 10 as shown in FIG. 4 and FIG. 5.

For this reason, when the pressing member 111C is lowered, the tip end 111E, which is the portion of the pressing member 111C closest to the switch main body 201, first comes in contact with the switch main body 201 (see FIG. 6). Then, accompanying the operation of the key 111B, the back surface 111D of the pressing member 111C comes into contact with the surface of the switch main body 201 from the tip end 111E toward the rear end portion 111F. As a result, the tip end 111E becomes fitted against the switch main body 201. Consequently, the switch main body that is built into the switch main body 201 is pressed.

Figure 7:
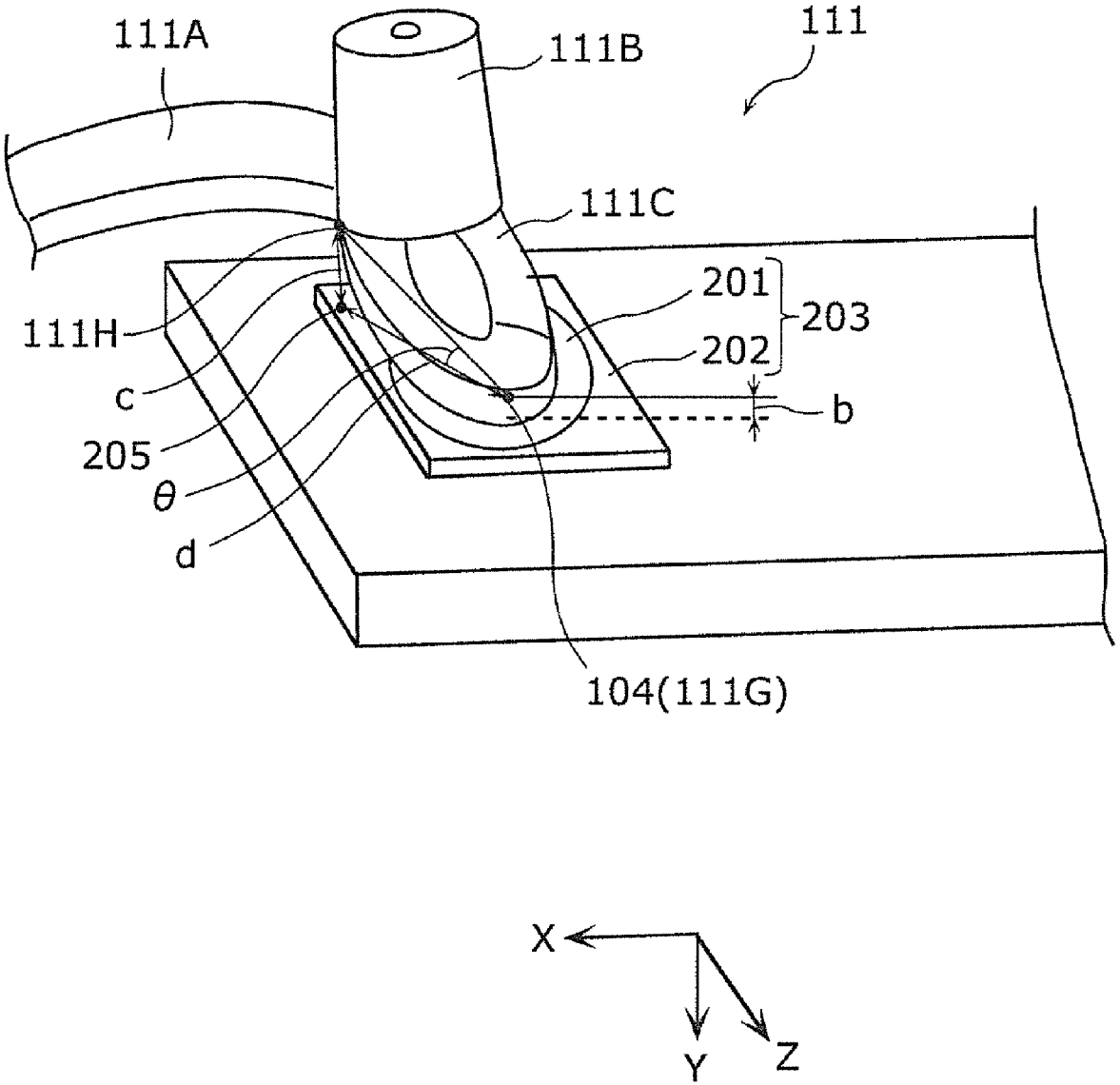
FIG. 7 is a diagram illustrating an example of a method for determining a second angle, being a perspective view representing an operation key in a state of pressing a switch main body.

An example of a method for determining the second angle θ will be described below using the FIG. 4 as well as FIGS. 7, 8A and 8B. FIG. 7 is a diagram illustrating a method for determining the second angle θ, being a perspective view representing an operation key 111 in the state of pressing the switch main body 201.

Figure 8B:
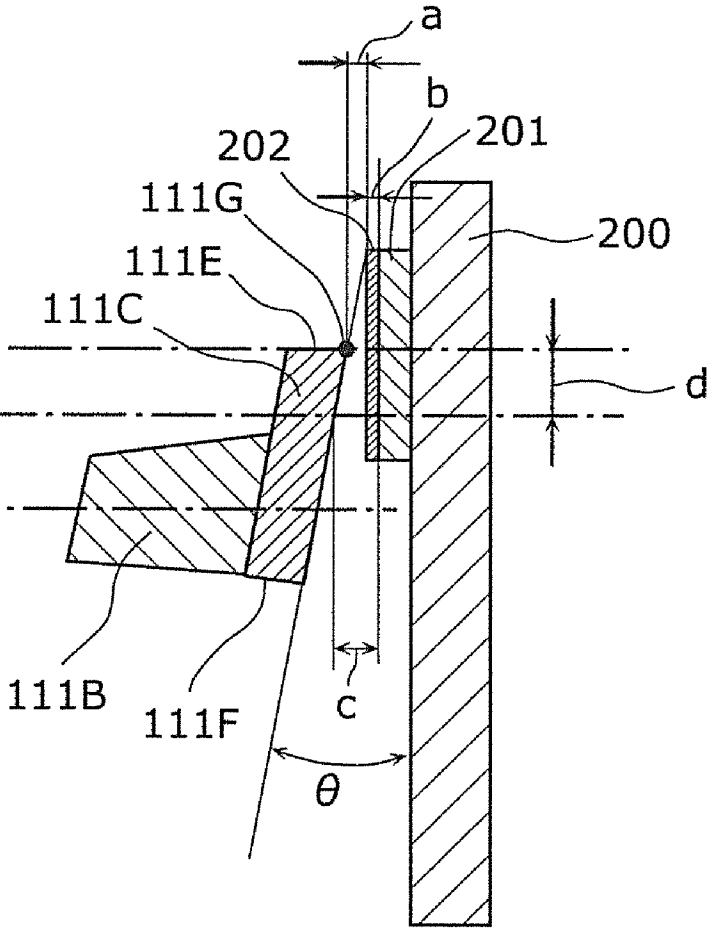
Figure 8A:
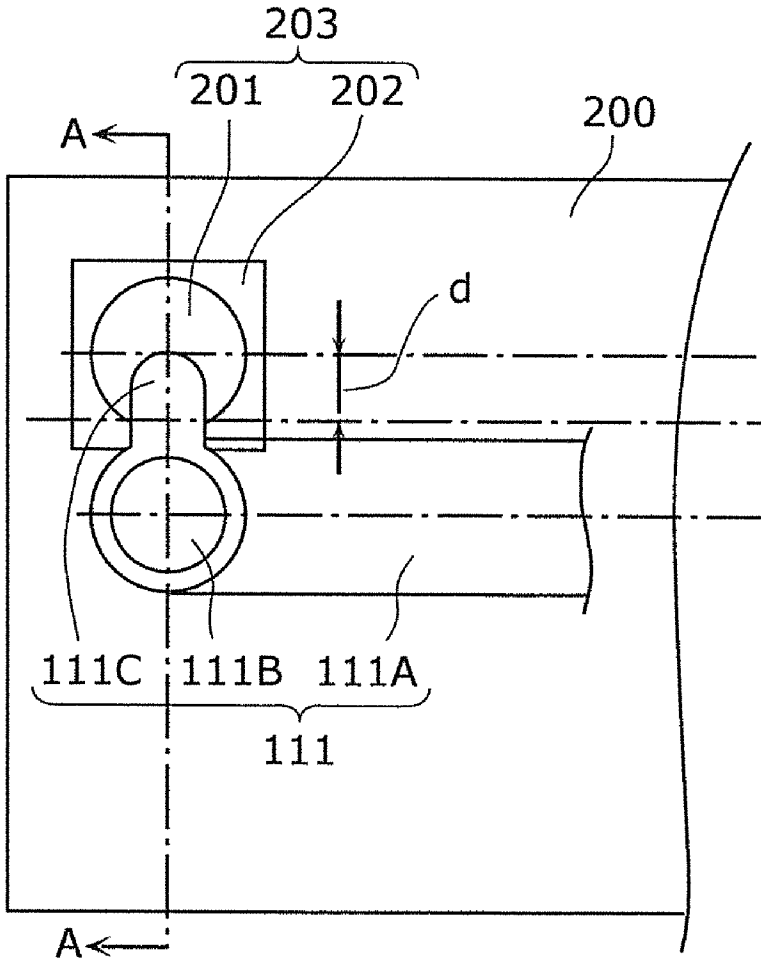

FIGS. 8A and 8B are diagrams illustrating the method for determining the second angle θ, wherein FIG. 8A represents a surface view of the operation key 111 and the switch 203, and FIG. 8B is a sectional view along line A-A in FIG. 8A.

In FIGS. 7, 8A and 8B, a represents the distance, in a state in which the key 111B is not pressed, from the surface of the switch main body 201 to the location of the pressing member 111C that strikes the surface of the switch main body 201 (hereinafter referred to as the "action point") 111G (see FIG. 4).

b represents the distance by which the action point 111G is pressed into the switch main body 201 from the time when the action point 111G comes into contact with the surface of the switch main body 201 until the switch main body is turned on.

c represents the shortest distance between the protrusion 111A and the metal plate 202 in a state in which the switch main body 201 is pressed in by the action point 111G.

d represents the distance from the center 204 of the switch main body 201 to the point 205 at which a vertical, drawn from the point 111H at which the shortest distance between the protrusion 111A and the metal plate 202 is obtained, crosses the metal plate 202.

The variables a through d are used to create a conditional expression according to which the protrusion 111A does not touch the switch 203 when the key 111B is pressed by the user, which yields:

$$\theta > \tan^{-1}\{(a+b)/c\} \quad \text{(Expression 1)}$$

Expression 1 is obtained as described below.

First, the conditional expression according to which the protrusion 111A does not touch the metal plate 202 when the key 111B is pressed by the user is:

$$a+b<c \quad \text{(Expression 2)}$$

Moreover, the second angle θ is defined between the surface 111D of the pressing member 111C and the surface of the switch main body 201 as described previously, so a right triangle is obtained with point 111G, point 111H, and point 205 being as the apexes as shown in FIG. 7. This right triangle is utilized to express c in terms of θ, which yields:

$$c=d\times\tan\theta \quad \text{(Expression 3)}$$

Then, when Expression 3 is substituted into Expression 2, and θ is expressed in terms of a, b and c, Expression 1 is obtained.

If the second angle θ satisfies Expression 1, then the protrusion 111A will not touch the switch 203 when the key 111B is pressed by the user.

As was described above, with the switch structure according to Preferred Embodiment 1 of the present invention, the protrusion 111A is configured to define a predetermined first angle (90° here) with the pressing member 111C.

Because of this, it is possible to significantly reduce or minimize the surface area of the protrusion that faces the switch. As a result, when the key 111B receives the pressing operation by the user, it becomes less likely for the protrusion 111A to strike the switch 203. As a result, it is possible to improve the operability of the operation key 111 without adding any separate components.

In addition, because the operation key 111 is configured by arranging the pressing member 111C and the protrusion 111A to define a specified angle, it is possible to provide the operation key 111 within a narrow region on the front cabinet 11 without adding any separate components in the same manner as the conventional operation key 400 (see FIG. 12). As a result, the cost is significantly reduced.

Furthermore, the operation key 111 preferably is provided within a narrow region of the front cabinet 11, so it is possible to make the bezel 12 of the liquid crystal display device 1 smaller and narrower and to make the liquid crystal display device 1 thinner in the forward-rearward direction.

Moreover, the operation key 111 is configured by arranging the pressing member 111C and the protrusion 111A so as to define a specified angle, so there is no need for a complex mold structure to form the operation key 111. Thus, lower costs are achieved.

In addition, the pressing member 111C is pushed into the switch main body 201 when the key 111B is pressed, so the switch main body turns on and off lightly. Thus, the user receives a light "clicking" sensation.

Preferred Embodiment 2

Figure 9:
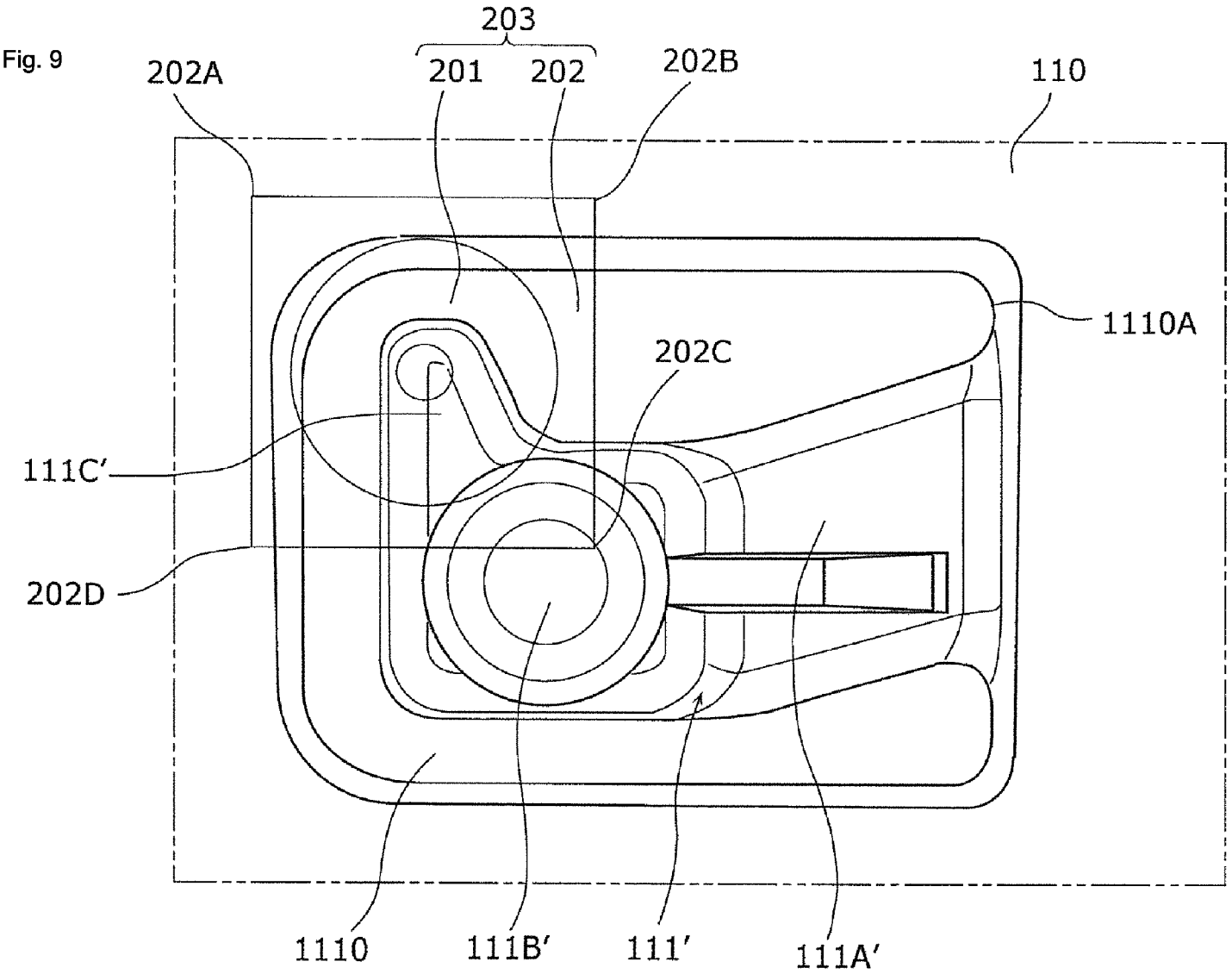
FIG. 9 is a plan view showing one example of a switch structure according to Preferred Embodiment 2 of the present invention.
Figure 10:
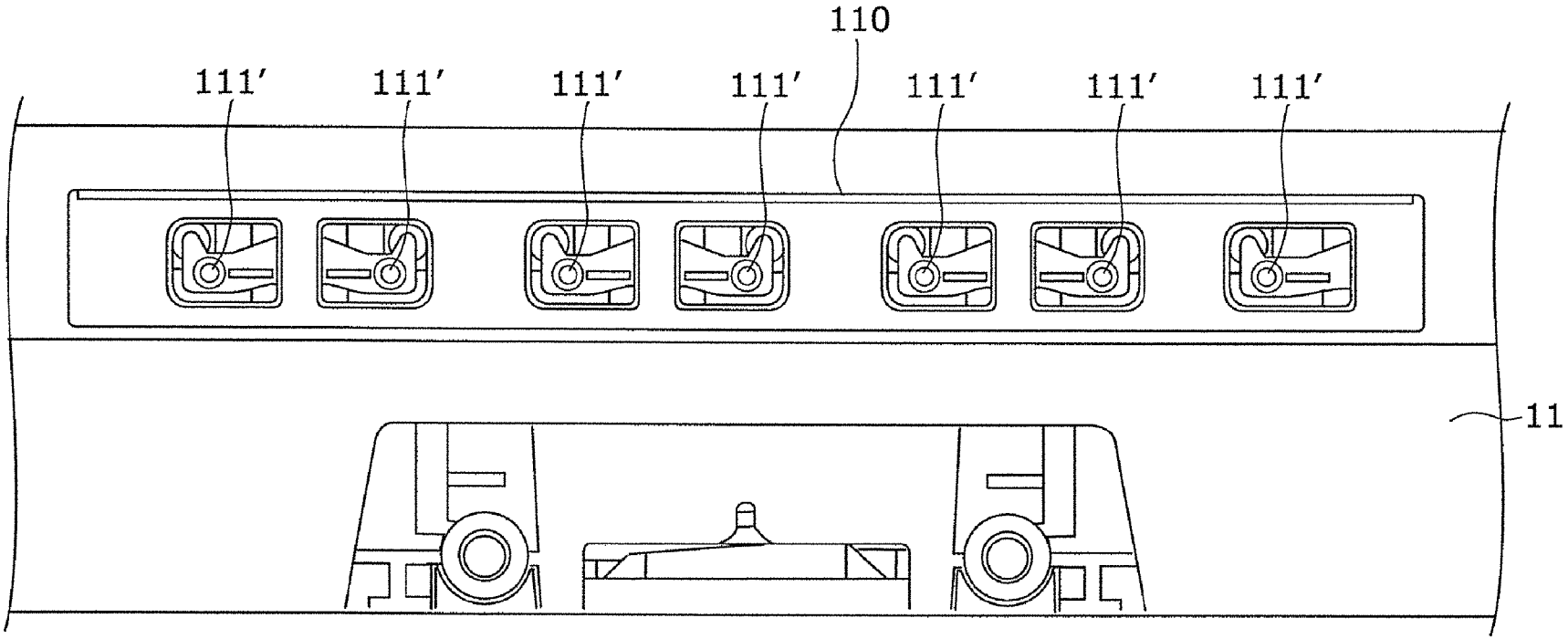
FIG. 10 is a plan view showing one example of a front cabinet including the switch structure according to Preferred Embodiment 2 of the present invention.

FIG. 9 is a plan view showing one example of the switch structure according to Preferred Embodiment 2 of the present invention. FIG. 10 is a plan view showing one example of a front cabinet including the switch structure according to Preferred Embodiment 2. Note that in FIGS. 9 and 10, those constituent elements that are the same as in the switch structure shown in FIG. 3 are given the same symbols, and an explanation thereof has been omitted.

In this example, the lower portion (operation key attachment) of the front cabinet 11 and the operation keys 111 preferably are constituted of plastic or other such resin having insulation properties.

Signal lines and ground lines are often connected to the four apexes 202A to 202D of the metal plate 202 of each switch 203. For this reason, each of the apexes is covered with the resin in order to prevent static electricity from outside from reaching to the metal plate 202.

Thus, in order to cover the four apexes 202A to 202D of each metal plate 202 with resin, a protrusion 111A' is configured so as to protrude from an opening end surface 1110A' in a direction at an angle less than 90°, for example. Furthermore, a key 111B' is provided at the tip end of the protrusion 111A'. This key 111B' is configured such that this key 111B' covers the apex 202C of the metal plate 202. Moreover, a pressing member 111C' extends from the key 111B' in a direction that defines an angle of approximately 45° with respect to the protrusion 111A', for example.

Thus, with the switch structure according to Preferred Embodiment 2, the protrusion 111A' protrudes from the opening end surface 1110A in a direction at an angle smaller than 90°, and the pressing member 111C' is provided in a direction subtending an angle of approximately 45° with respect to the protrusion 111A', for example.

Consequently, static electricity from outside is prevented from reaching the metal plate 202. In addition, it is possible to significantly reduce the warping of the protrusion 111A' when the key 111B' is pressed.

Preferred Embodiment 3

Figure 11:
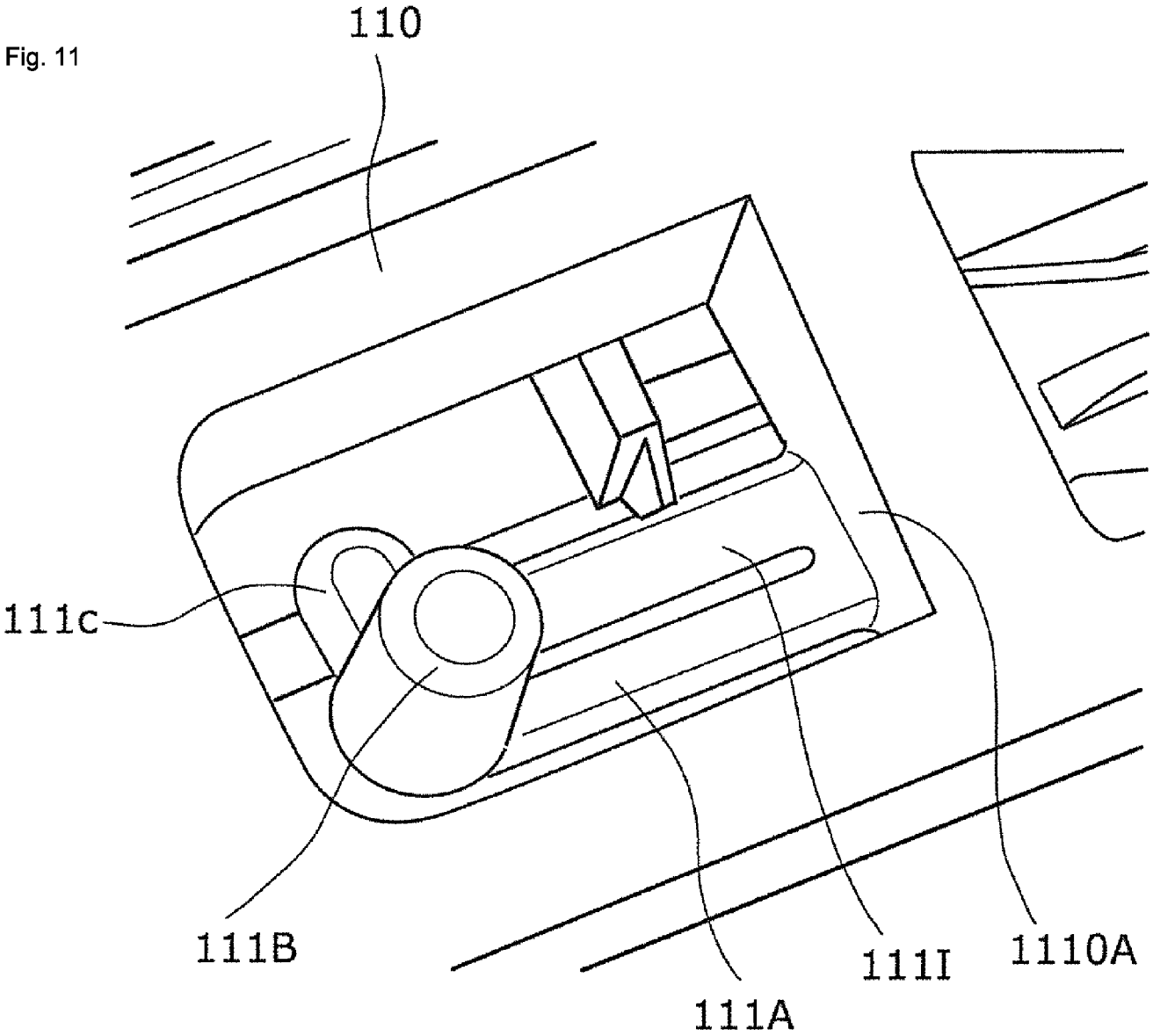
FIG. 11 is a diagram showing one example of a switch structure according to Preferred Embodiment 3 of the present invention.

FIG. 11 is a perspective view showing one example of the switch structure according to Preferred Embodiment 3 of the present invention. In FIG. 11, a rib 111I extending from the key 111B in the direction heading toward the opening end surface 1110A is provided on the protrusion 111A. As a result, the protrusion 111A has strong rigidity in the portions where the rib 111I is provided, but the rigidity of the portions in the vicinity of the opening end surface 1110A becomes weaker.

For this reason, when the key 111B receives the pressing operation by the user, the pressing member 111C moves smoothly with the vicinity of the opening end surface 1110A as the fulcrum, thus pressing the surface of the switch main body 201. Consequently, even if the pressing operation is performed with a weak force, the user receives a light "clicking" sensation.

Preferred Embodiment 4

Figure 12A:
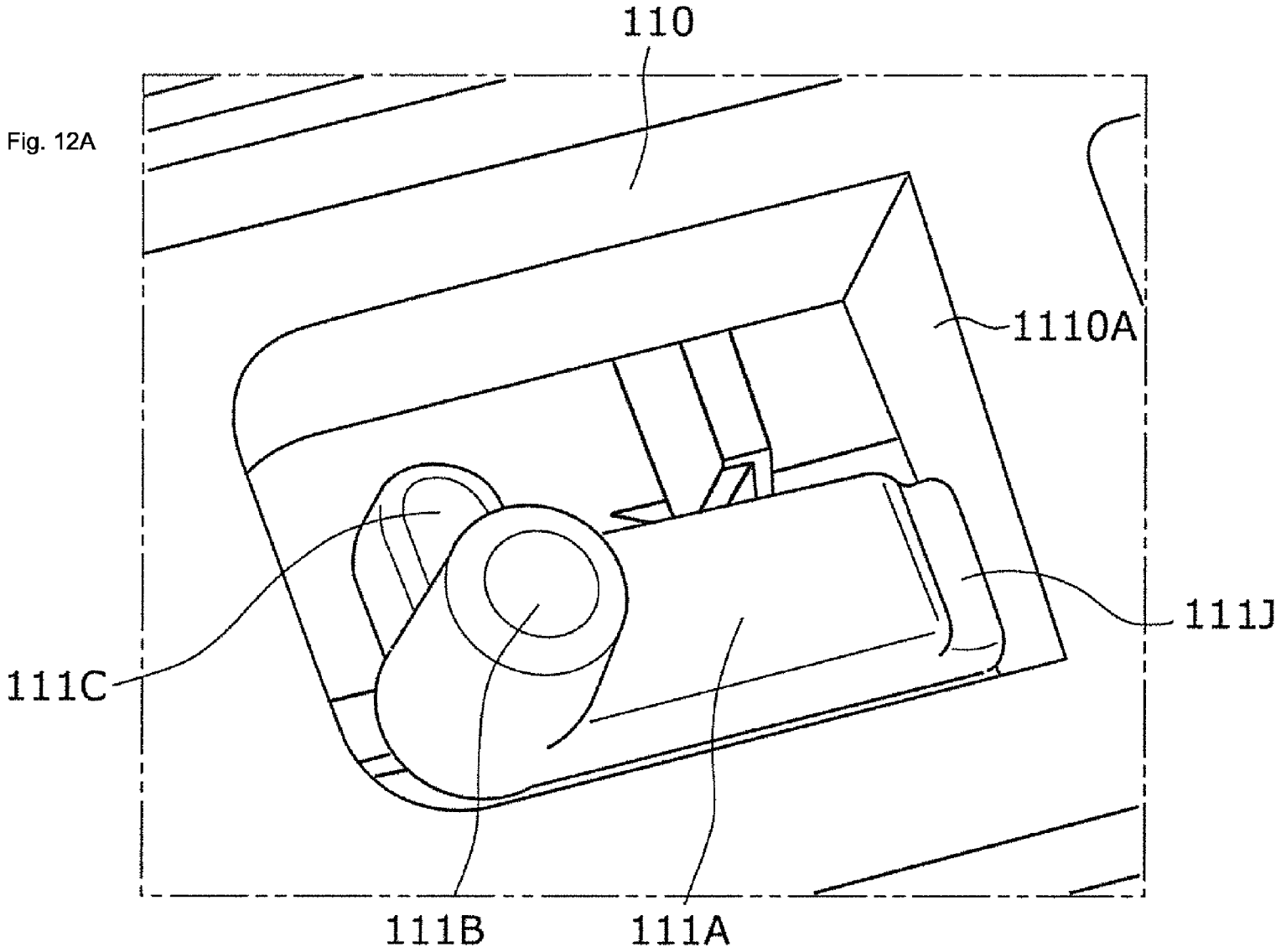
FIG. 12A is a perspective view showing one example of a switch structure according to Preferred Embodiment 4 of the present invention.
Figure 12B:
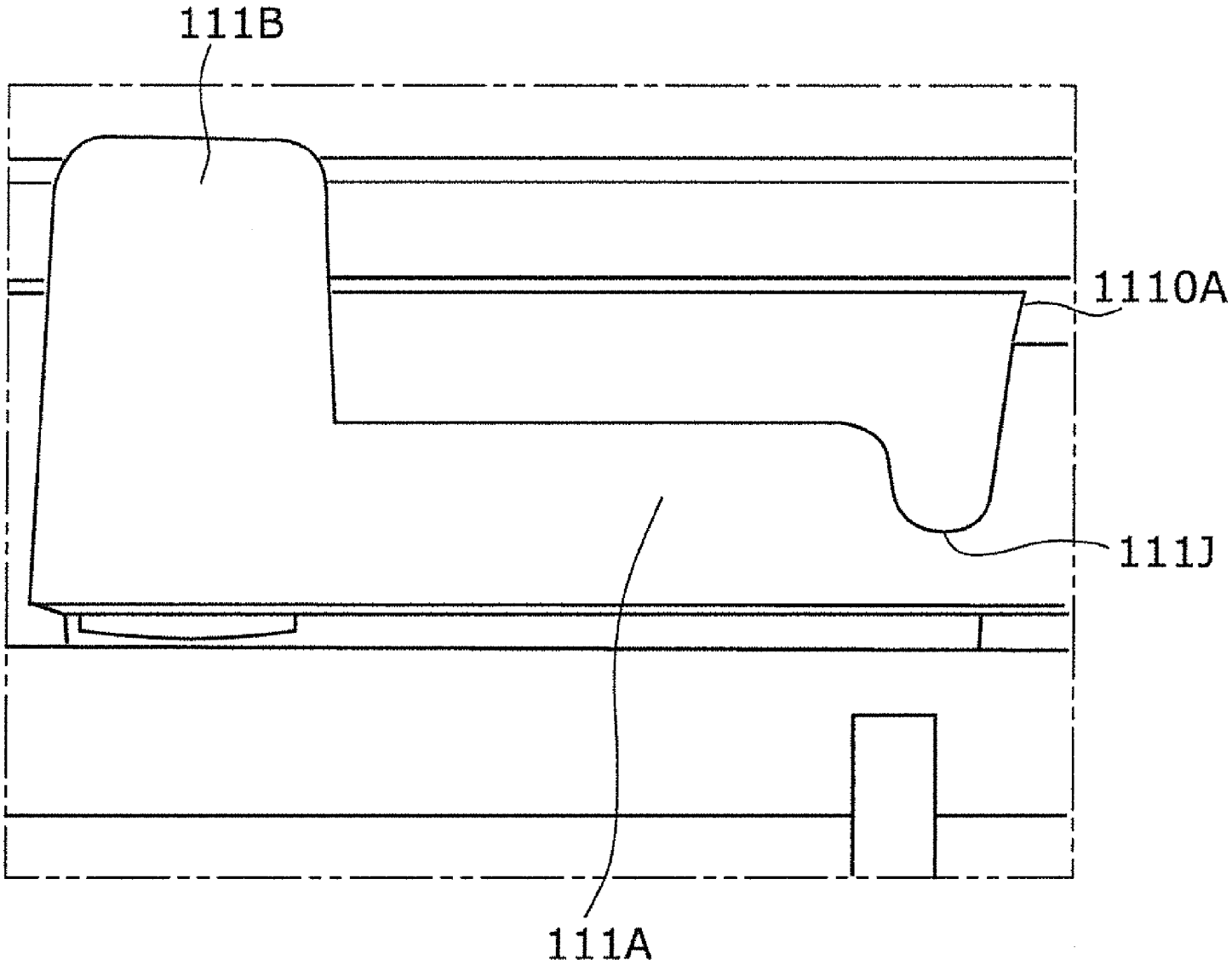
FIG. 12B is side view of FIG. 12A.
Figure 13A:
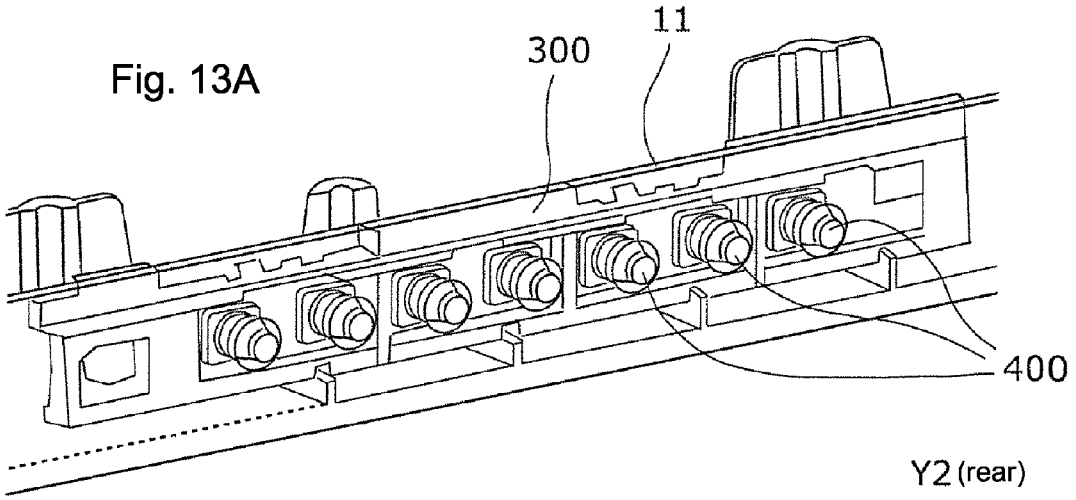
FIGS. 13A and 13B are diagrams showing the structure of conventional operation keys.
Figure 13B:
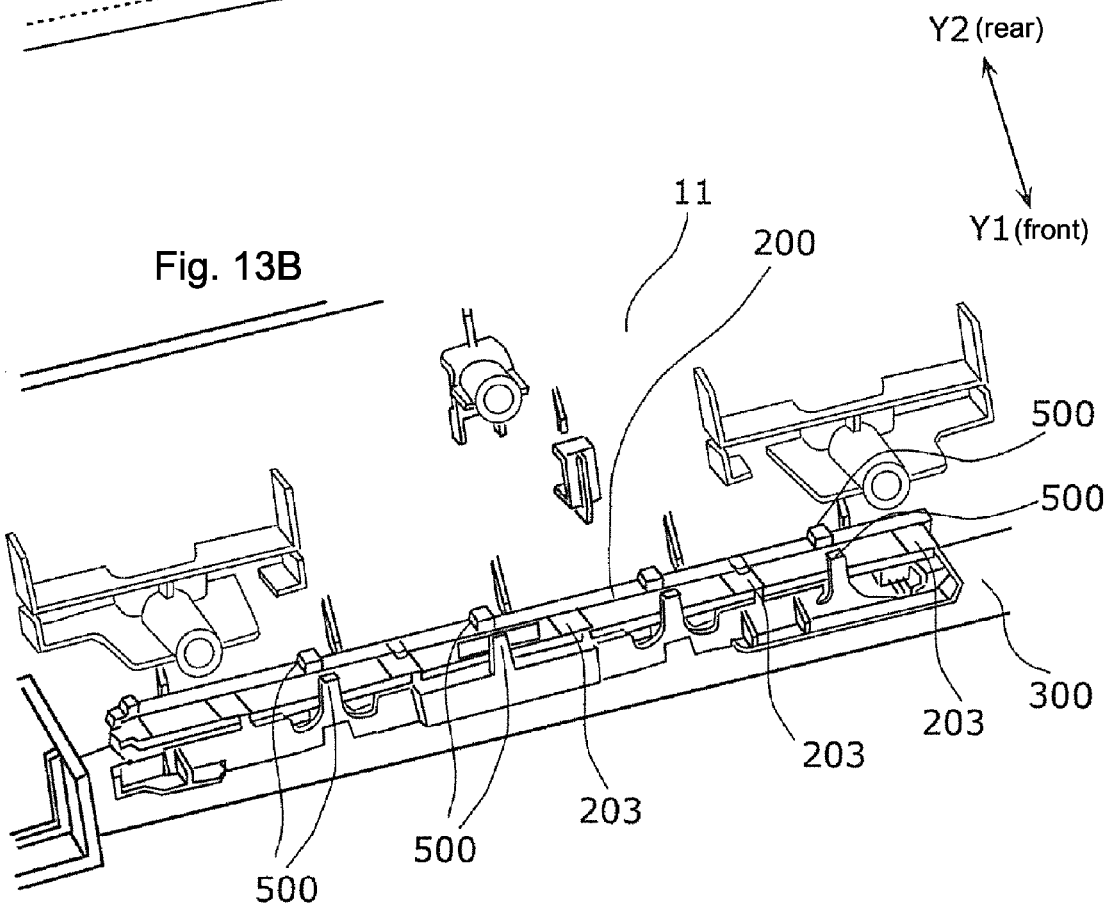
Figure 14:
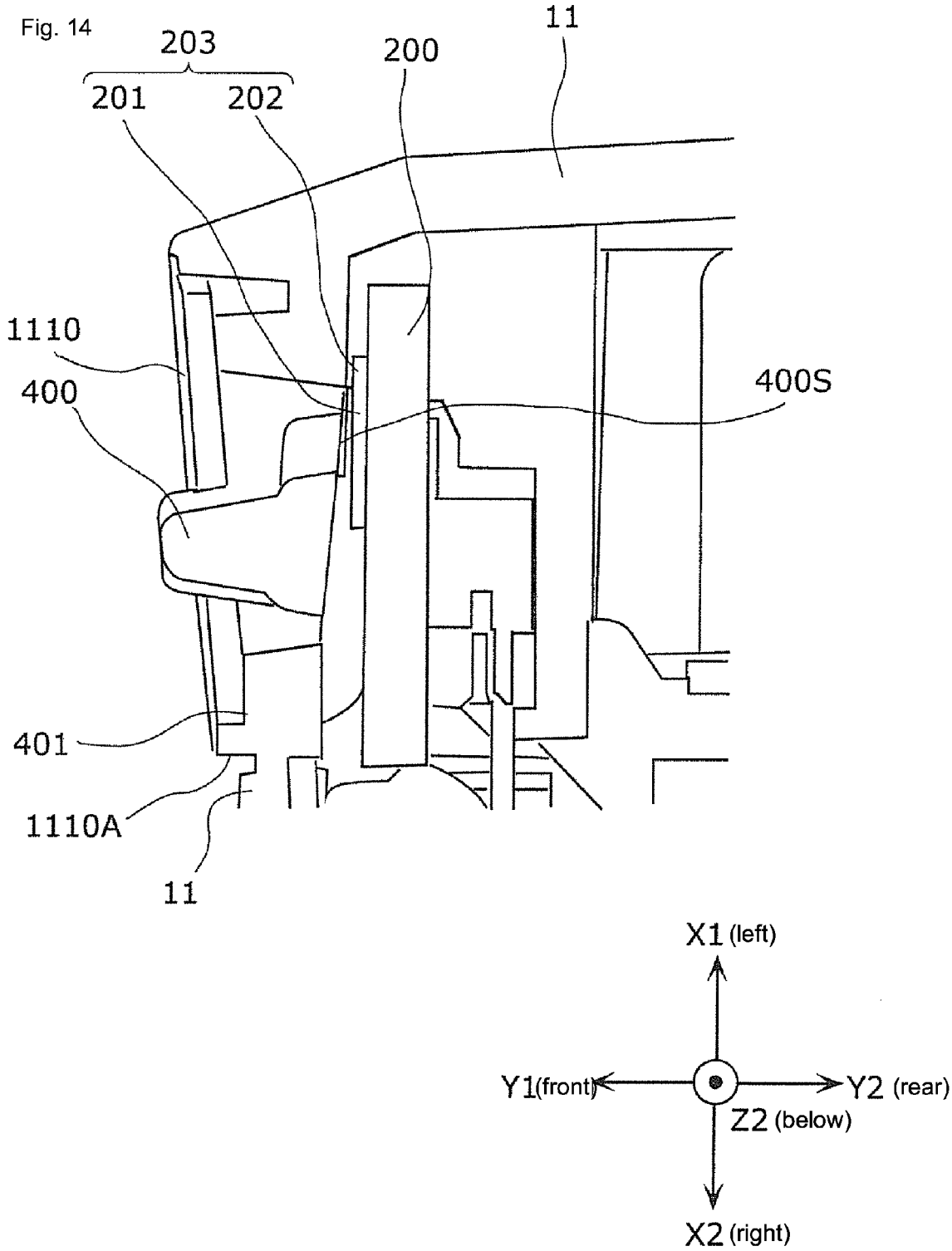
FIG. 14 is a side view showing an operation key that is formed without adding any separate components.
Figure 15A:
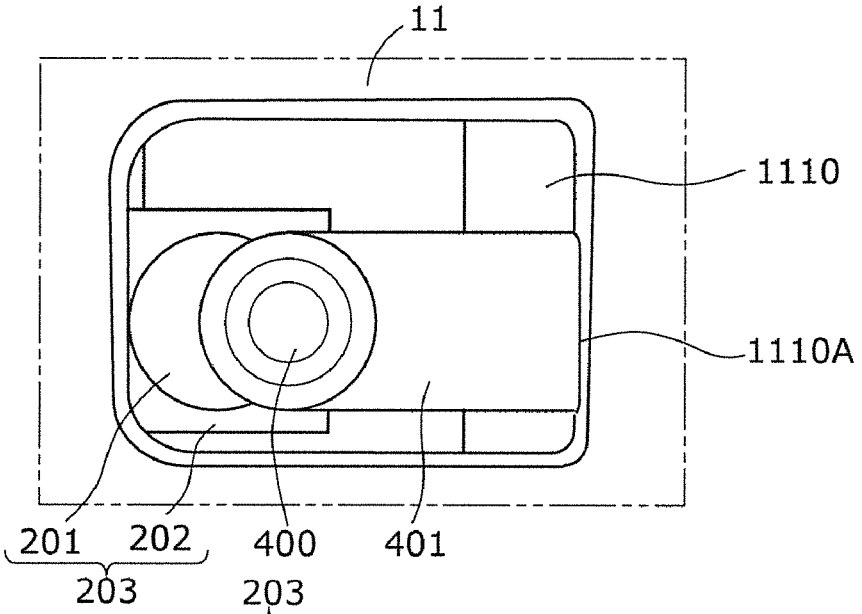
FIGS. 15A-15C are diagrams illustrating the problems of the operation key of FIG. 14.
Figure 15B:
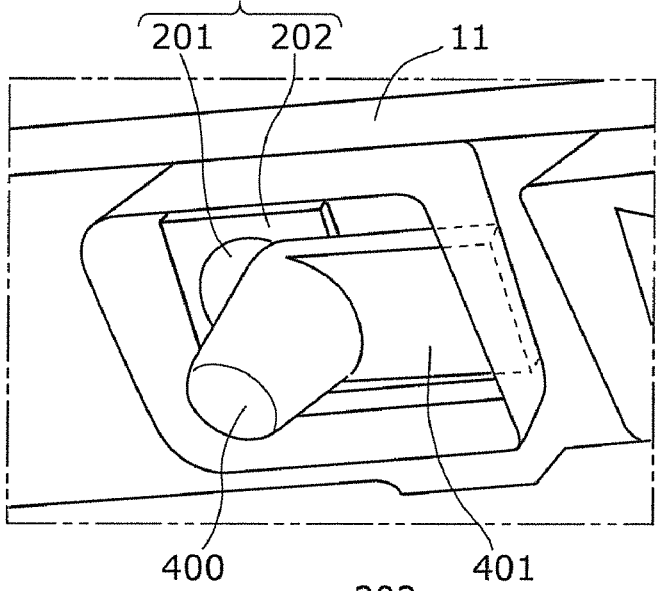
Figure 15C:
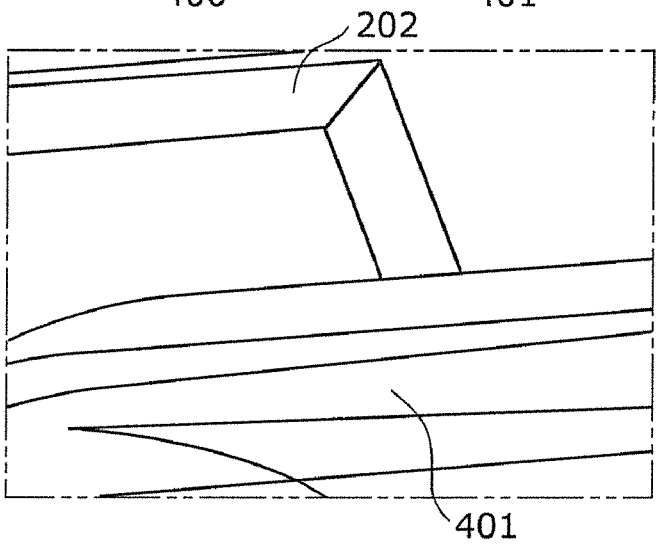
Figure 16:
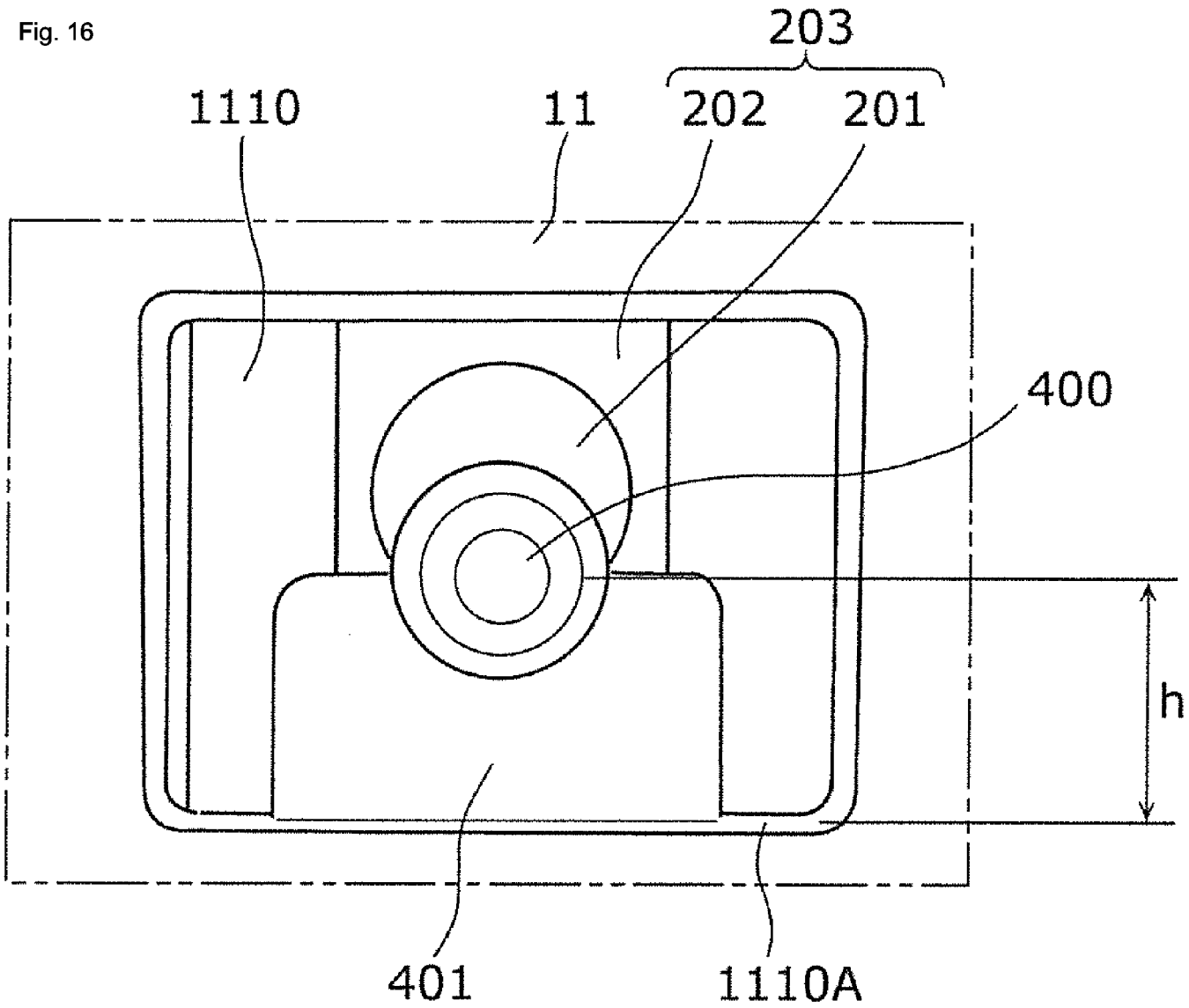
FIG. 16 is a diagram illustrating the problems of the operation key of FIG. 14.
Figure 17A:
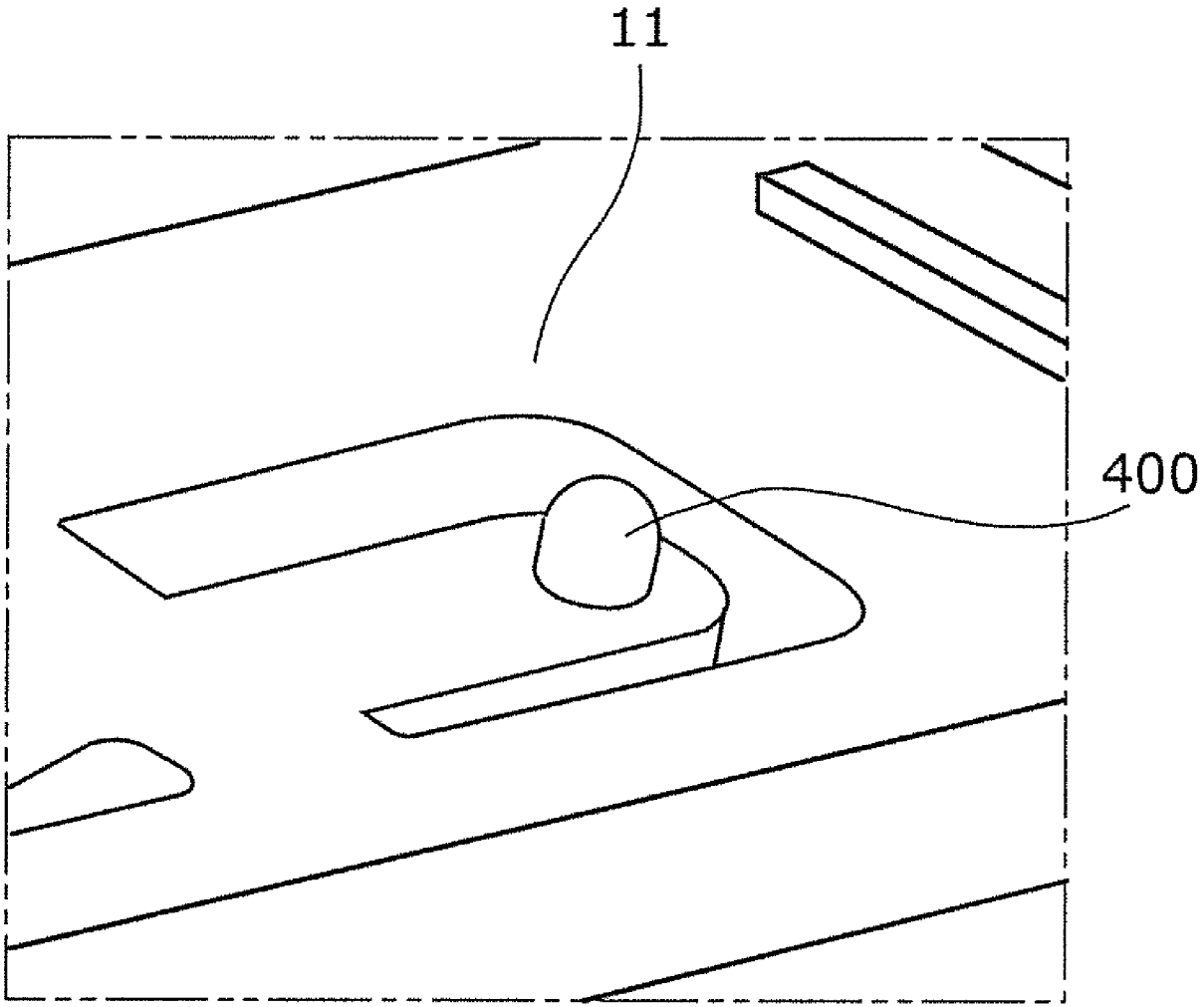
FIG. 17A is a diagram illustrating the problems when operation keys are formed by using a slide mechanism.
Figure 17B:
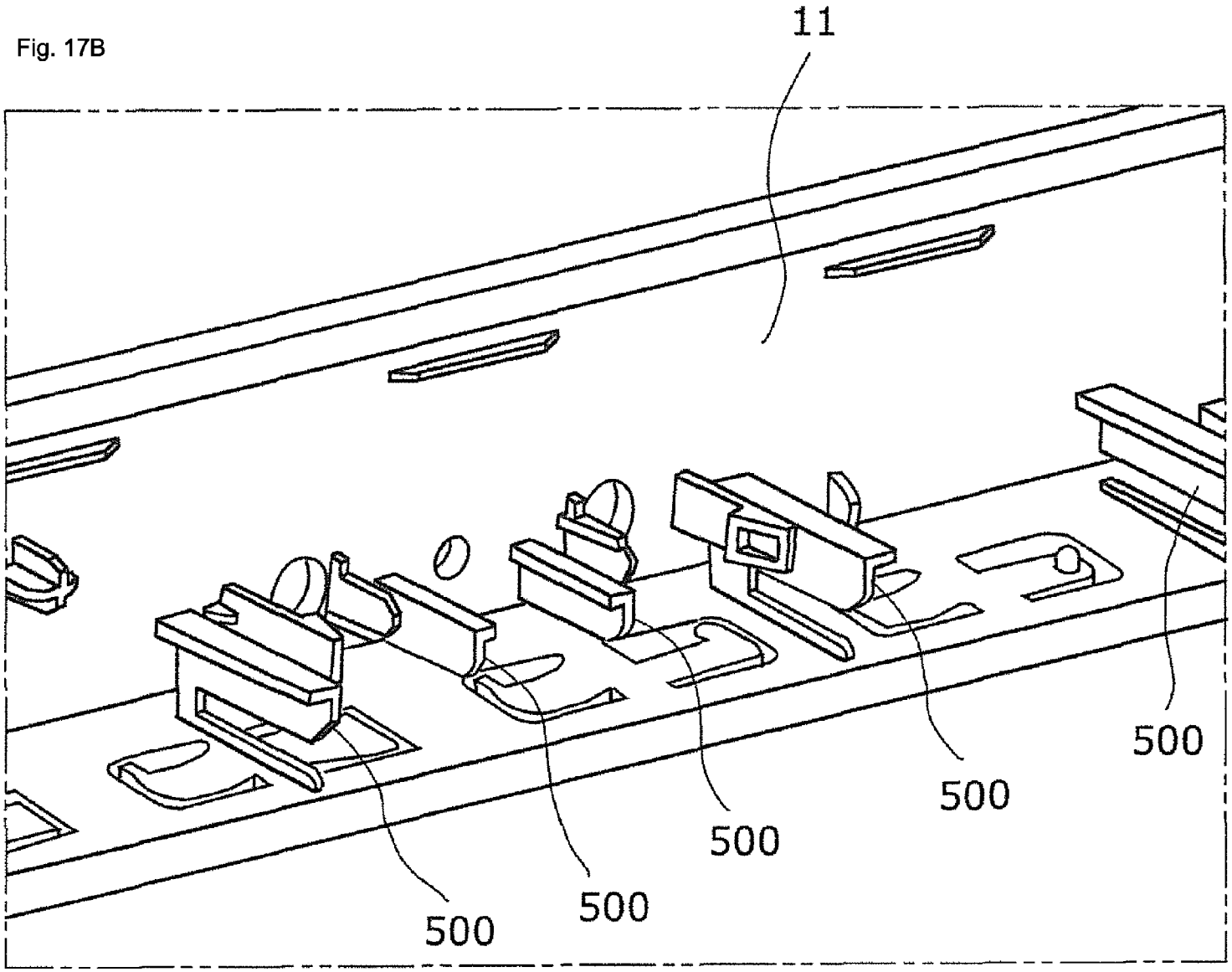
FIG. 17B is a diagram illustrating the problems when operation keys are formed by using a slide mechanism.

FIG. 12A is a perspective view showing one example of the switch structure according to Preferred Embodiment 4 of the present invention. FIG. 12B is a side view of FIG. 12A.

In FIG. 12A, a recess 111J is provided at the portion connecting the protrusion 111A and the opening end 1110A. Because of this, the protrusion 111A has weak rigidity in the portion of the recess 111J, but the rigidity of the remaining portions is strong.

Therefore, when the key 111B receives the pressing operation by the user, the pressing member 111C moves smoothly with the recess 111J as the fulcrum, thus pressing the surface of the switch main body 201. Consequently, the user receives a light "clicking" sensation even when performing a pressing operation with a weak force.

The switch structures and display device according to the present invention were described above based on preferred embodiments; however, the present invention is not limited to such preferred embodiments. The present invention also includes preferred embodiments and examples thereof which can be obtained by applying a variety of modifications conceived by a person skilled in the art within the scope of the present invention, as well as other preferred embodiments and examples thereof which can be obtained by arbitrarily combining the constituent elements of the preferred embodiments.

Preferred embodiments of the present invention can be applied to devices in which an operation key must be installed in a narrow area, such as a liquid crystal display device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A switch structure comprising:

an operation key attachment including an opening;

a substrate facing the operation key attachment and including a switch; and an operation key including a protrusion that protrudes parallel or substantially parallel to the substrate from an opening end surface which is an end surface of the opening, an operation receiver that is provided at a tip end of the protrusion and configured to accept a pressing operation in a direction toward the substrate, and a pressing member that extends from the operation receiver primarily in a direction parallel to the substrate, the direction being defined by a predetermined first angle with respect to the protrusion and that is used to press the switch; wherein the operation key and the operation key attachment are integrally formed;

the switch includes a switch main body that is pressed by the pressing member and a housing that encloses an outer periphery of the switch main body; and the pressing member includes a surface on a side of the switch main body that is inclined with respect to the surface of the switch main body at a predetermined second angle.

2. The switch structure according to claim 1, wherein the first angle is 90° or about 90°.

3. The switch structure according to claim 1, wherein the protrusion includes a rib that extends from the operation receiver in a direction toward the opening end surface.

4. The switch structure according to claim 1, wherein a recess is located at the portion connecting the protrusion and the opening end surface.

5. The switch structure according to claim 1, wherein the operation key attachment and the operation key are made of resin;

the housing includes a metal plate having a square or substantially square external shape; and four corners of the metal plate are covered by the operation key attachment and the operation key.

6. The switch structure according to claim 1, wherein the housing includes a metal plate; and when θ represents the second angle, a represents a distance, in a state in which the switch main body is not being operated, from a surface of the switch main body to a location on the pressing member that strikes the surface of the switch main body defined as an action point, b represents a distance by which the action point is pressed into the switch main body from a time when the action point comes into contact with the surface of the switch main body until the switch main body is pressed in, and c represents a distance between the protrusion and the metal plate in a state in which the switch main body is pressed in by the action point, the angle θ satisfies Expression 1 below:

$$\theta > \tan^{-1}\{(a+b)/c\} \quad \text{(Expression 1).}$$

7. The switch structure according to claim 1, wherein the operation receiver includes a convex key.

8. A display device comprising:

a switch structure including:

an operation key attachment including an opening;

a substrate facing the operation key attachment and including a switch; and an operation key including a protrusion that protrudes parallel or substantially parallel to the substrate from an opening end surface which is an end surface of the opening, an operation receiver that is provided at a tip end of the protrusion and configured to accept a pressing operation in a direction toward the substrate, and a pressing member that extends from the operation receiver primarily in a direction parallel to the substrate, the direction being defined by a predetermined first angle with respect to the protrusion and that is used to press the switch;

a display that displays images; and a front cabinet that encloses an outer periphery of the display; wherein the operation key and the operation key attachment are integrally formed; and the operation key attachment is provided on a lower portion of the front cabinet.

9. The switch structure according to claim 1, wherein at least a portion of the switch is exposed from the opening in the operation key attachment.

10. The switch structure according to claim 1, wherein the protrusion protrudes from the opening end surface in a direction perpendicular or substantially perpendicular to the opening end surface.

11. The switch structure according to claim 1, wherein the substrate faces a back surface of the operation key attachment.

12. The switch structure according to claim 1, wherein, in response to the pressing operation, the protrusion flexes upward.

13. The switch structure according to claim 1, wherein the pressing member is arranged to strike the surface of the switch main body in a direction that is perpendicular or substantially perpendicular to the substrate.

14. The switch structure according to claim 8, wherein the first angle is 90° or about 90°.

15. The switch structure according to claim 8, wherein the switch includes a switch main body that is pressed by the pressing member and a housing that encloses an outer periphery of the switch main body;

the pressing member includes a surface on a side of the switch main body that is inclined with respect to the surface of the switch main body at a predetermined second angle.

16. The switch structure according to claim 15, wherein the housing includes a metal plate; and when θ represents the second angle, a represents a distance, in a state in which the switch main body is not being operated, from a surface of the switch main body to a location on the pressing member that strikes the surface of the switch main body defined as an action point, b represents a distance by which the action point is pressed into the switch main body from a time when the action point comes into contact with the surface of the switch main body until the switch main body is pressed in, and c represents a distance between the protrusion and the metal plate in a state in which the switch main body is pressed in by the action point, the angle θ satisfies Expression 1 below:

$$\theta > \tan^{-1}\{(a+b)/c\} \quad \text{(Expression 1).}$$

17. The switch structure according to claim 8, wherein the operation receiver includes a convex key.

18. The switch structure according to claim 8, wherein at least a portion of the switch is exposed from the opening in the operation key attachment.

19. The switch structure according to claim 8, wherein the protrusion protrudes from the opening end surface in a direction perpendicular or substantially perpendicular to the opening end surface.

20. The switch structure according to claim 8, wherein the substrate faces a back surface of the operation key attachment.

* * * * *